US005132668A

United States Patent [19]

Lee

[11] Patent Number: 5,132,668

[45] Date of Patent: Jul. 21, 1992

[54] HEAT SENSING ALARM ASHTRAY

[76] Inventor: Tekung Lee, 2F, No. 218, Jaoho Street, Sungshan, Taipei, Taiwan

[21] Appl. No.: 637,134

[22] Filed: Jan. 3, 1991

[51] Int. Cl.[5] ..... G08B 21/00

[52] U.S. Cl. ..... 340/584; 340/540; 340/586; 340/693

[58] Field of Search ..... 340/584, 586, 540, 693

[56] References Cited

U.S. PATENT DOCUMENTS

| | | | |
|---|---|---|---|
| 4,094,326 | 6/1978 | Newman | 131/234 |
| 4,119,419 | 10/1978 | Passaro et al. | 340/628 |
| 4,428,386 | 1/1984 | Alloway | 116/67 R |
| 4,595,905 | 6/1986 | May | 340/527 |

*Primary Examiner*—Glen R. Swann, III

*Attorney, Agent, or Firm*—Bacon & Thomas

[57] ABSTRACT

An ashtray provided with a heat sensing element, an IC plate and an amplifier for emitting an alarm sound when a cigarette supported on the ashtray has burned down close to the edge of the ashtray.

3 Claims, 4 Drawing Sheets

HEAT SENSING ALARM ASHTRAY

BACKGROUND OF THE INVENTION

Cigarette smoking is a widespread habit in our daily life and involves men and women of all age groups. Because of this habit, ashtrays are also a common requirement for receiving the ashes of burning and spent cigarettes. Besides the health risks posed by cigarette smoking, this habit also poses the risk of fires caused by lighted cigarettes. For example, a smoker may easily forget that he or she is holding a burning cigarette while socializing or working. It is often required that smoking be restricted or forbidden during certain times or at certain locations in order to prevent risking fires and endangering lives.

When a burning cigarette is placed on an ashtray, the greatest risk of fire occurs when the cigarette has burned down towards the edge of the ashtray. Since the ashtray is relied upon for the safety of a burning cigarette, there is a need for an ashtray capable of providing an alarm to the cigarette smoker when the risk of a fire arises.

SUMMARY OF THE INVENTION

The present invention provides an improved ashtray which is capable of sounding an alarm when a cigarette has burned down towards the edge of the ashtray and poses the greatest risk of starting a fire. This is realized by providing an ashtray with a heat sensing element in the ashtray body adjacent the slot on which the burning cigarette is supported. When the cigarette has burned down towards the sensing element, a signal is sent by the element to activate an IC element with an appropriate power source, and thereby further activate an amplifier to emit a sonic warning. This serves to warn the user to extinguish the cigarette, thereby avoiding the risk of starting a fire.

Other objects, features and advantages of the invention shall become apparent from the following detailed description of a preferred embodiment thereof, when taken in conjunction with the drawings wherein like reference characters refer to corresponding parts of the several views.

DETAILED DESCRIPTION OF THE PREFERRED EMBODIMENT

Figure 1:
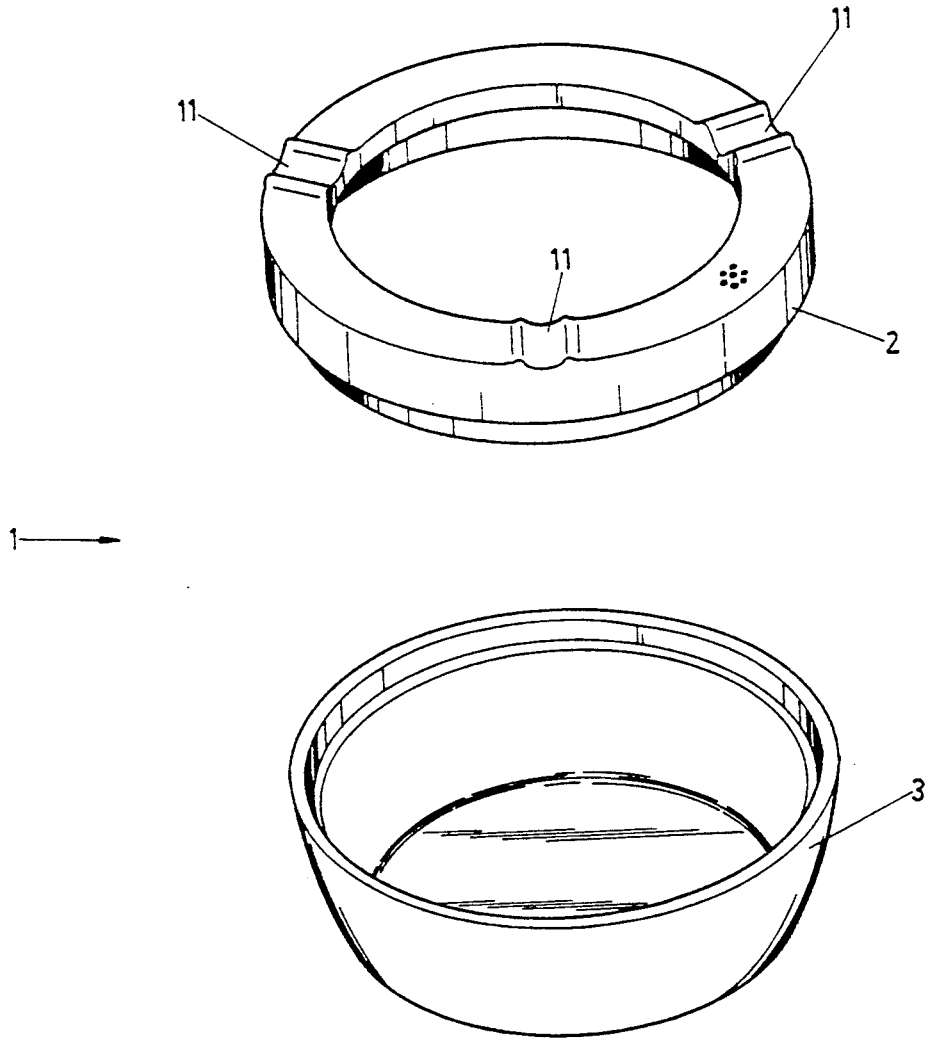
FIG. 1 is an exploded perspective view of an ashtray according to a preferred embodiment of the invention.

An ashtray 1 according to a preferred embodiment of the invention shall now be described with initial reference to FIG. 1. As seen therein, ashtray 1 includes an upper cover 2 and a bottom tank 3. The top portion of cover 2 is provided with a plurality of circumferentially spaced slots 11 for supporting cigarettes. The bottom portion of cover 2 and top portion of tank 3 are correspondingly configured with matching flanges for engagement with each other.

Figure 2:
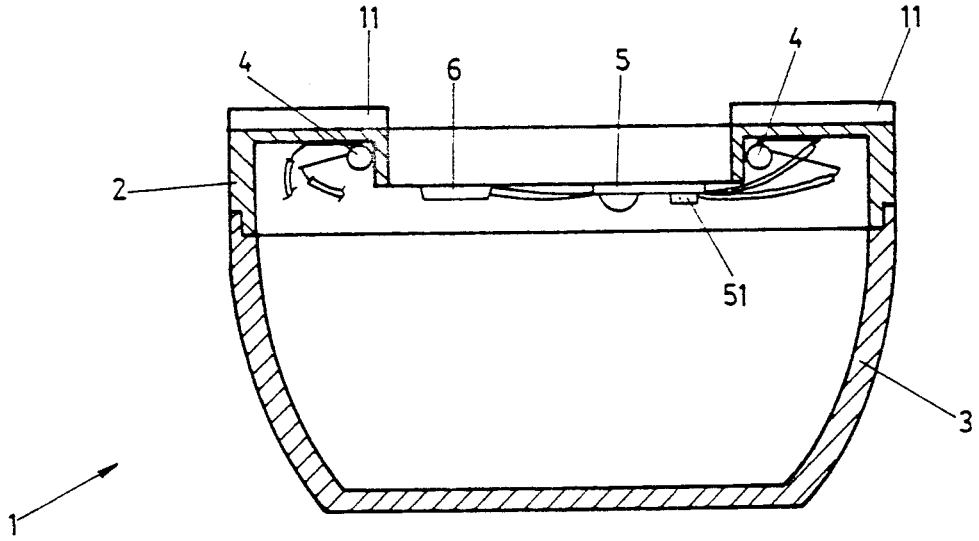
FIG. 2 is a front elevational view, taken in cross section, of the ashtray, and particularly depicting the sonic warning system incorporated therein.
Figure 3:
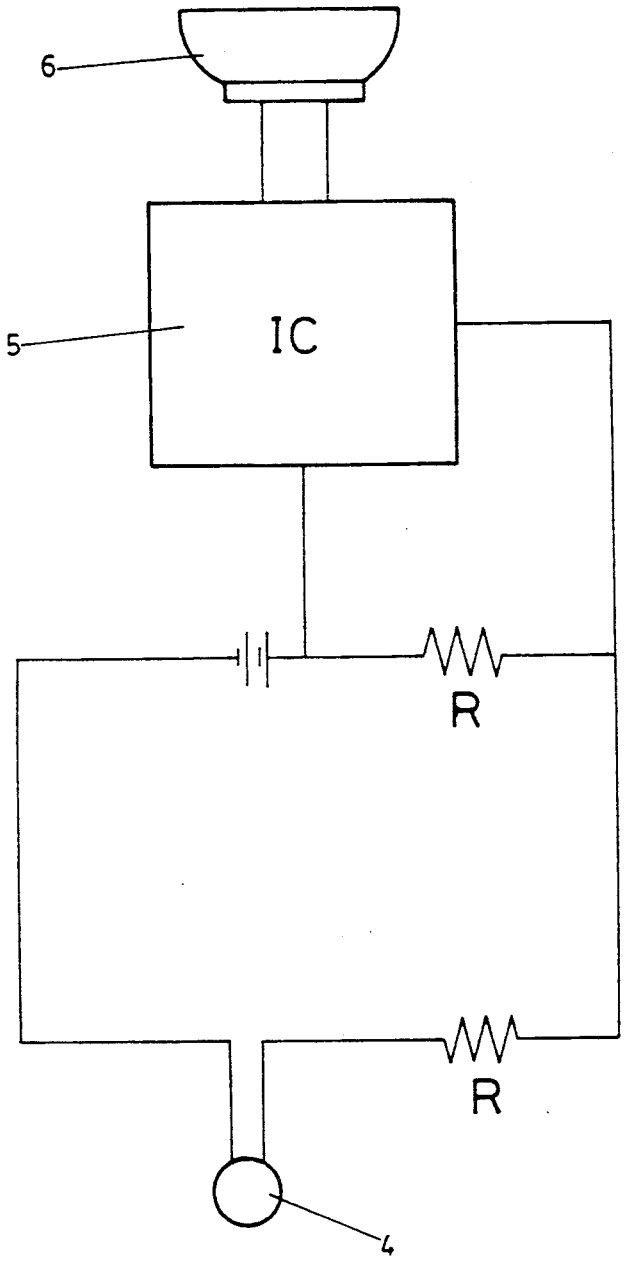
FIG. 3 is a schematic diagram of the circuitry used in the sonic warning system.

With reference to FIG. 2, it is seen that upper cover 2 is provided with a plurality of heat sensing elements 4 which are positioned adjacent slots 11. Sensing elements 4 are in electrical connection with an IC plate 5 and an amplifier 6. Each element 4 is positioned internally of cover 2 and at the lower section of its corresponding slot 11. Element 4 may also be positioned at the edge of slot 11, protrude outwardly or in any other position for optimum heat sensing efficacy. It is therefore apparent that heat sensing element 4, IC plate 5 and amplifier 6 collectively form a sonic alarm for ashtray 1, with the preferred circuitry of this alarm being schematically depicted in FIG. 3.

Figure 4:
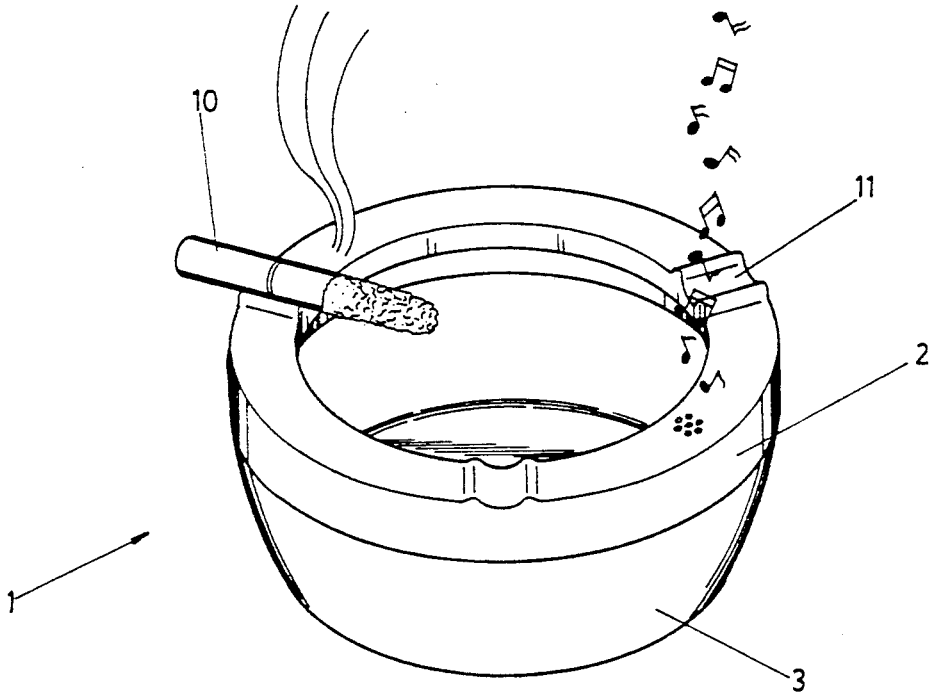
FIG. 4 is a perspective view of the ashtray shown with a burning cigarette supported thereon during activation of the sonic alarm.

When a smoking cigarette 10 is initially placed in a slot 11 of ashtray 1, no sonic alarm is emitted until the tip of the cigarette has burned down towards the inward edge of slot 11, as indicated in FIG. 4. When this occurs, sensing element 4 is activated by the heat of cigarette 10 and immediately transmits a signal to IC plate 5 through the closing and opening action of element 4. It is understood that element 4 may be of any conventional design deemed suitable for the practice of the invention as described herein. Upon activation by sensing element 4, IC plate 5 emits an acoustic signal, preferably musical tones, which is then transmitted to amplifier 6 for conversion into an audible sound. This serves to warn the user that cigarette 10 has burned to the edge of slot 11, thereby requiring immediate action to extinguish cigarette 10 and thereby avoid the latter from dropping off of ashtray 1 and possibly initiating a fire.

It is also preferred to provide an appropriate timer for the alarm to limit or control the activation by sensing element 4 in order to assure positive and persistent warning to the user. For example, the signal transmitted by sensing element 4 might be delayed for 20 to 30 seconds and, if the user has failed to take appropriate action for cigarette 10, then the signal is thereafter transmitted after the delay period and persistently maintained to provide a positive warning to the user.

When ashtray 1 is constructed with a sonic alarm of the type capable of providing pleasing musical sounds, it is also possible of the user of ashtray 1 to intentionally activate such sounds by placing the burning tip of a cigarette adjacent sensing element 4. Thus, ashtray 1 provides not only a safety alarm capability, but also musical enjoyment when desired.

As therefore apparent, the primary objective of the present invention is to provide an improved ashtray having heat sensing and musical sound alarm capabilities for the dual purpose of providing safety during smoking and musical entertainment.

I claim:

1. A heat sensing alarm ashtray comprising:

a) a bottom tank;

b) an upper cover for attachment to the bottom tank;

c) at least one slot on a top portion of the upper cover for supporting a burning cigarette;

d) a sonic alarm carried by a bottom portion of the upper cover, which alarm includes a heat sensing element positioned adjacent the slot for transmitting a signal when activated by the heat of the burning cigarette, an IC plate for receiving the signal from the heat sensing element and converting the signal into an acoustic signal, and an amplifier for receiving the acoustic signal from the IC plate and producing a corresponding alarm sound.

2. The ashtray of claim 1 further including a plurality of slots circumferentially spaced around the top portion of the upper cover and a heat sensing element positioned adjacent each slot.

3. The ashtray of claim 1 wherein the corresponding alarm sound includes musical tones.

* * * * *